US006328797B1

(12) United States Patent
Parzych et al.

(10) Patent No.: US 6,328,797 B1
(45) Date of Patent: Dec. 11, 2001

(54) CLEANING AND EPOXY APPLICATION TABLE FOR LAMINATE STRIPS

(76) Inventors: Jeffrey G. Parzych, 233 Chapel Dr., Tallahassee, FL (US) 32304; Tony Fiorito, 301 Gold Tree St., Punta Gorda, FL (US) 33955

( * ) Notice: Subject to any disclaimer, the term of this patent is extended or adjusted under 35 U.S.C. 154(b) by 0 days.

(21) Appl. No.: 09/515,893

(22) Filed: Feb. 29, 2000

(51) Int. Cl.[7] ..... B05C 13/00; B05B 5/08

(52) U.S. Cl. ..... 118/66; 118/72; 118/500

(58) Field of Search ..... 118/302, 324, 118/314, 313, 66, 58, 500, 501; 427/325, 207.1, 424; 428/322.2

(56) References Cited

U.S. PATENT DOCUMENTS

| | | | | |
|---|---|---|---|---|
| 3,367,823 | | 2/1968 | Clausen et al. . | |
| 3,986,917 | | 10/1976 | Diaz . | |
| 4,010,203 | | 3/1977 | Aylon . | |
| 4,039,369 | | 8/1977 | Versteege . | |
| 4,371,309 | | 2/1983 | Principe et al. . | |
| 4,702,664 | | 10/1987 | Lukens, Jr. . | |
| 5,039,375 | | 8/1991 | DeLigt et al. . | |
| 5,052,332 | * | 10/1991 | Hajek et al. | 118/72 |
| 5,059,276 | | 10/1991 | DeLigt et al. . | |
| 5,279,667 | * | 1/1994 | Blankenship et al. | 118/63 |
| 5,895,546 | | 4/1999 | Bielfeldt et al. . | |

* cited by examiner

*Primary Examiner*—Richard Crispino
*Assistant Examiner*—Yewebdar T. Tadesse
(74) *Attorney, Agent, or Firm*—Shoemaker and Mattare

(57) ABSTRACT

A cleaning and epoxy application table for laminate strips includes a pair of movable rails for guiding strip material over the table, first beneath a solvent sprayer that cleans the strip, a drier for removing the solvent, and then to an epoxy adhesive application station which places a continuous film of adhesive on the cleaned surface of the strip.

10 Claims, 5 Drawing Sheets

CLEANING AND EPOXY APPLICATION TABLE FOR LAMINATE STRIPS

BACKGROUND OF THE INVENTION

This invention relates to a cleaning and epoxy application table for laminate strips.

A strip of material may be adhered to a substrate, or built up on other strips of material, by spreading a film of adhesive on one side of the strip, and then pressing the strip against the substrate. It is important that the adhesive application be uniform: that is, no spots should be left uncoated, and the film should have a uniform thickness. An additional requirement for optimum adhesive performance is that the strip surface be free of oil and other contaminants before the adhesive is applied. It is customary to spray the strip surface with an solvent like MEK, prior to applying the adhesive.

Large manual lamination jobs involve repetitive motion which is fatiguing, particularly if the worker is required to manipulate and control the strip material unduly. A good lamination table, specifically designed for this type of job, would help reduce worker fatigue and could improve productivity.

Some prior tables for applying glue to various materials have been developed. Examples are disclosed in U.S. Pat. Nos. 5,895,546, 5,059,276, 5,039,375, 4,702,664, 4,371,309, 4,039,369, 4,010,203, 3,986,917 and 3,367,823. None of these devices, however, is particularly suitable for handling laminate strip material which must be cleaned and then coated with adhesive.

SUMMARY OF THE INVENTION

An object of the invention is to simplify the task of cleaning laminate strip material and applying epoxy adhesive to the cleaned surface. Related objects are to reduce worker fatigue and improve productivity.

These and other objects are attained by a cleaning and epoxy application table for laminate strips as described in detail further below. The table is fitted with means such as guide rails for guiding laminate strip material along a path from an upstream end of the table to a downstream end thereof, and with a solvent sprayer for directing a solvent mist at the upper surface of the laminate strip. The solvent-wetted surface of the strip is sourced by an abrasive pad. Air jets downstream of the sprayer remove solvent from said surface, and then the strip passes through a box of adhesive which adheres to the surface. The strip material leaves the adhesive box coated with a film of adhesive.

BRIEF DESCRIPTION OF THE DRAWINGS

In the accompanying drawings.

DESCRIPTION OF THE PREFERRED EMBODIMENT

Figure 1:
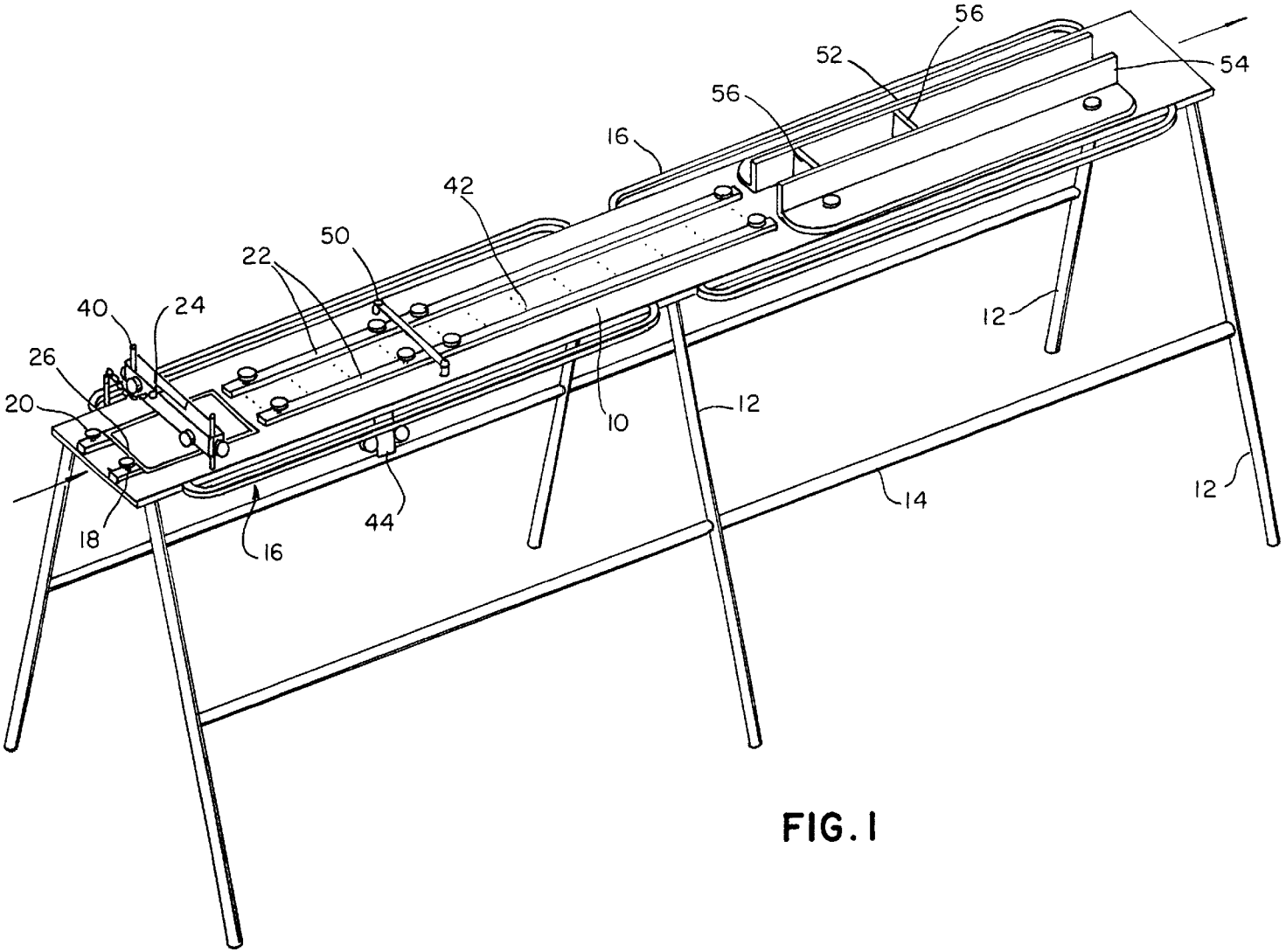
FIG. 1 is an isometric view of a cleaning and epoxy application table for laminate strips, embodying the invention.

A cleaning and epoxy application table for laminate strips embodying the invention comprises (see FIG. 1) an aluminum table top 10, about ½ inch thick and a foot wide, supported by a substructure including at least two pair of legs 12 with suitable bracing, such as the horizontal rails 14 shown, to keep the legs stable. Items 16 are carrying handles attached to the edges of the table.

Figure 2:
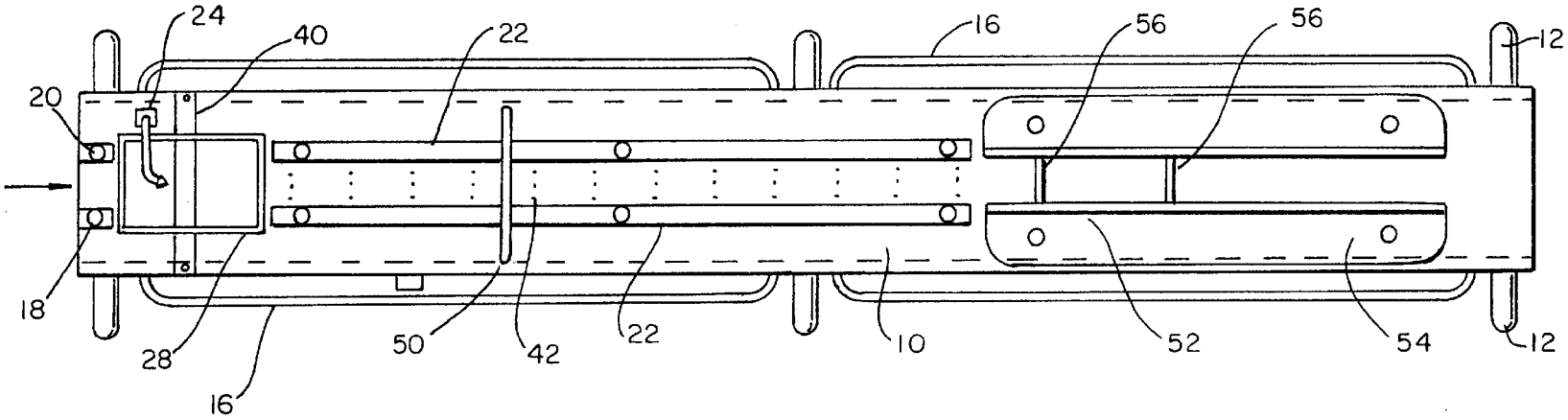
FIG. 2 is a top plan view thereof.
Figure 3:
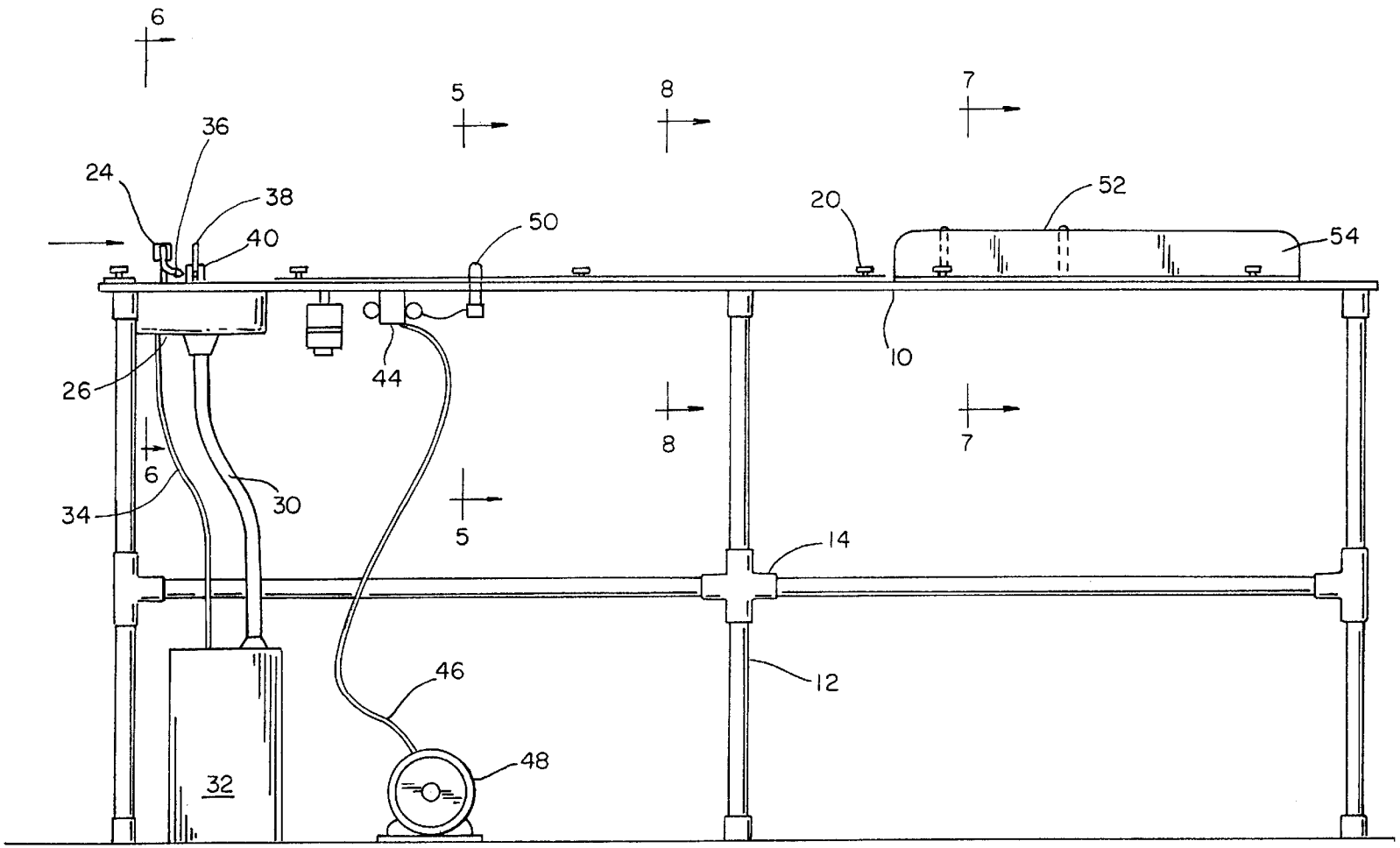
FIG. 3 is a front elevation thereof.
Figure 4:
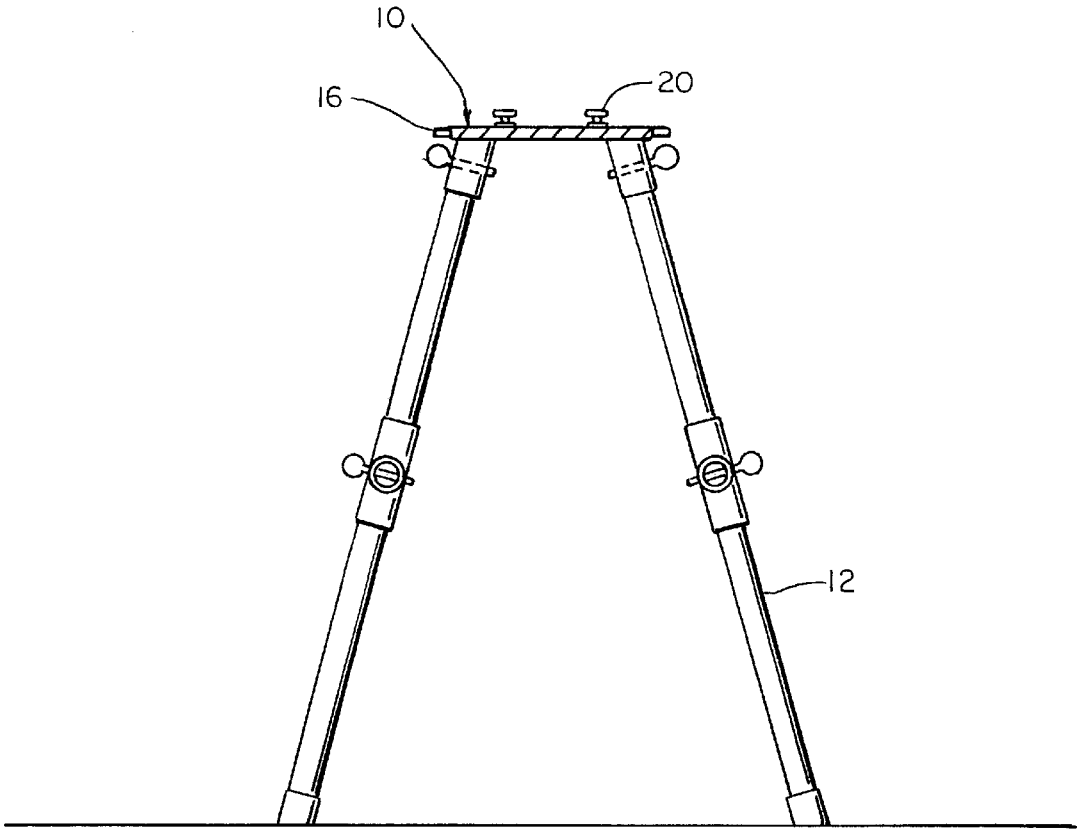
FIG. 4 is a left end elevation thereof.
Figure 5:
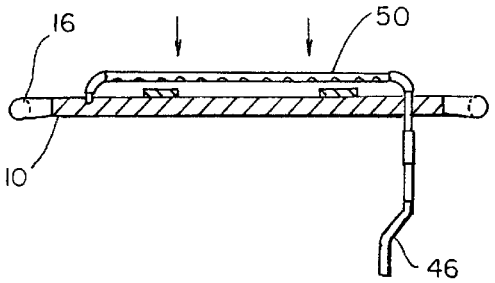
FIG. 5 is a partial sectional view thereof, on the vertical plane 5—5 shown in FIG. 3.
Figure 7:
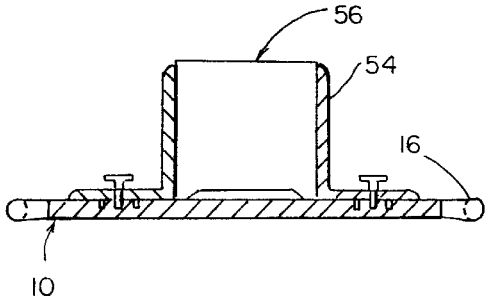
FIG. 7 is a partial sectional view thereof, taken on the vertical plane 7—7 shown in FIG. 3.
Figure 6:
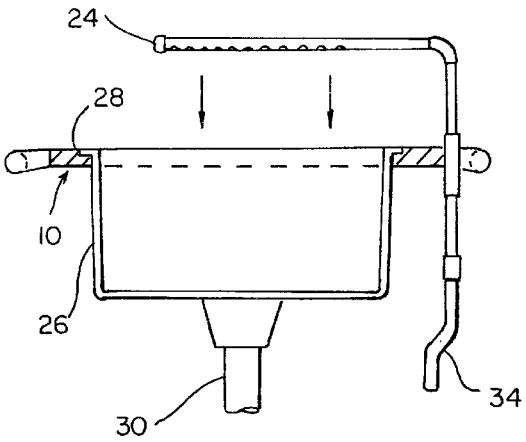
FIG. 6 is a partial sectional view thereof, taken on the vertical plane 6—6 shown in FIG. 3.
Figure 8:
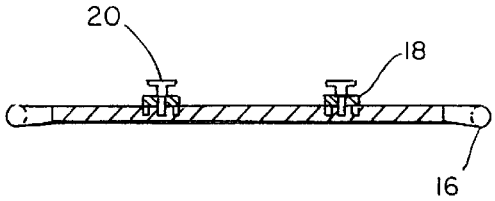
FIG. 8 is a partial sectional view thereof, taken on the vertical plane 8—8 shown in FIG. 3.

The left end of the table in FIGS. 2 and 3 will be referred to as the upstream end, and the right end is the downstream end, indicating the intended normal movement of strips over the table. At the far upstream end of the table, there are two short guide rails 18, releasably clamped to the table surface by thumb screws 20. Threaded holes for receiving the screws are formed at different spacings across the table (see FIGS. 7 and 8), so that the guide rails can be moved to handle strips of different widths. These short guide rails 18 are aligned with a similar but longer pair of guide rails 22—also secured by thumb screws—just downstream of a cleaning station. The cleaning station includes a solvent sprayer 24 (FIG. 6)—preferably a nozzle at the end of an adjustable gooseneck—above the table, and a solvent drip pan 26 seated in an undercut opening 28 in the table. One can see in FIG. 3, that the drip pan 26 is connected by a tube 30 to a solvent reservoir 32 at ground level. The reservoir contains a filter and a pump (neither shown) which delivers clean solvent through a feed hose 34 back to the solvent sprayer 24. The sprayer comprises a pneumatically assisted nozzle 36, mounted at the end of an adjustable gooseneck, producing a solvent mist which falls primarily on the upper surface of the laminate strip. The sprayer is just upstream of a sponge-backed scouring pad 38, supported on a bracket 40 affixed to the table.

The table is perforated with an array of holes 42 extending downstream from the cleaning station. The holes in the array overlie a common air manifold 44, which is supplied with compressed air by a supply hose 46 leading to an air compressor 48. The manifold also communicates with an drying tube 50 that passes transversely above the table. The drying tube is also perforated at the bottom, so that it directs a curtain of air downward at the upper surface of the laminate strip to dry it before adhesive is applied. The air escaping upward from the holes 42 in the table provides a frictionless air cushion beneath the strip.

An epoxy application box 52 is provided at the downstream end of the table. The box is defined between a pair of aluminum L-channel members 54 which are adjustably secured to the table by thumb screws, and a pair of divider plates 56. The side of the divider plates are received in vertical slots (not visible) in the inner faces of the channel members. Divider plates of different widths are used when the channel members are moved inward or outward to accept laminate strips of different widths. The bottom edge of that divider plate is preferably not straight, but rather very slightly arched so that its is slightly higher in the middle than at the corners.

In use, the air compressor and solvent pump are run continuously. The adhesive application box (the rectangular area between the channel members and the divider plates) is filled with an epoxy adhesive, and a heavy free weight is preferably placed on top of the adhesive to generate some adhesive pressure. Now a strip of laminate is passed over the table between the guide rails and channel members. The upper surface of the strip is wetted by the solvent mist and the pad at the upstream end of the table, and the scouring pad rubs against the top surface of the strip as it passes beneath. Next, the surface of the strip is dried by air from the drying tube. When the laminate passes through the box 52, it is submerged in and coated by the adhesive. The bottom edge of the downstream divider plate squeegees off all but a suitably thin film of adhesive. As mentioned before, the bottom edge of that divider plate is slightly arched, that is, higher in the middle, so that it leaves a greater film thickness at the center of the strip, than at the edges.

An extension (not shown) may be added at the downstream of the table, to hold coated laminate strips before they are removed and used.

The preferred material for the structural elements of the invention is aluminum, since great strength is not required, and this makes the table easily portable. It should be understood, however, that the invention may be produced from various materials, including nonmetallic materials, and that any dimensions mentioned are not limiting of this invention.

Since the invention is subject to modifications and variations, we intend that the foregoing description and the accompanying drawings shall be interpreted as only illustrative of the invention defined by the following claims.

We claim:

1. A cleaning and epoxy application table for laminate strips comprising a table top having an upper surface, means for guiding laminate strip material along a path from an upstream end of the table to a downstream end thereof, a solvent sprayer for directing a solvent mist at a surface of the laminate strip, means for drying solvent from said surface, downstream of said sprayer, and means for applying adhesive to said surface, downstream of said drying means.

2. The invention of claim 1, wherein said guiding means comprises a pair of parallel guide rails secured to the table top.

3. The invention of claim 2, wherein said guide rails are adjustably secured to the table top by thumb screws, said table having laterally spaced threaded holes for receiving said screws at different spacings, to permit adjustment of the rail spacing.

4. The invention of claim 1, wherein said solvent sprayer comprises a nozzle disposed above the path of the laminate strip, a drip pan for catching solvent discharged from the nozzle, and a recirculating pump for returning solvent from the drip pan to the nozzle.

5. The invention of claim 4, wherein the nozzle has an articulating gooseneck.

6. The invention of claim 1, wherein the drying means comprises a perforated tube passing across said path, and a source of compressed air connected to said tube.

7. The invention of claim 1, further comprising an array of air holes in said table top, an air manifold beneath said air holes, and means for connecting said manifold to a source of compressed air, whereby the air holes generate an air cushion beneath the laminate strip to provide for its frictionless movement over the table top.

8. The invention of claim 1, wherein the means for applying adhesive comprises a pair of guides for laterally confining the laminate strip, and a pair of divider plates extending between said guides, thereby enclosing an area above the laminate strip, which area may be filled with adhesive.

9. The invention of claim 8, further comprising a free weight sized just to fit within said area, so as to apply pressure to said adhesive.

10. The invention of claim 8, wherein each of said divider plates has a slightly arched bottom surface to distribute adhesive more thickly at the center of the center of the laminate strip.

* * * * *